US011827994B2

(12) United States Patent
Kobayashi et al.

(10) Patent No.: US 11,827,994 B2
(45) **Date of Patent: *Nov. 28, 2023**

(54) HOT STAMPED BODY

(71) Applicant: NIPPON STEEL CORPORATION, Tokyo (JP)

(72) Inventors: Akinobu Kobayashi, Tokyo (JP); Takehiro Takahashi, Tokyo (JP); Yasuaki Kawamura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 85 days.

This patent is subject to a terminal disclaimer.

(21) Appl. No.: 17/606,974

(22) PCT Filed: May 29, 2020

(86) PCT No.: PCT/JP2020/021434

§ 371 (c)(1),
(2) Date: Oct. 27, 2021

(87) PCT Pub. No.: WO2020/241859

PCT Pub. Date: Dec. 3, 2020

(65) Prior Publication Data

US 2022/0213607 A1 Jul. 7, 2022

(30) Foreign Application Priority Data

May 31, 2019 (JP) ..... 2019-102285

(51) Int. Cl.

| | |
|---|---|
| ***C25D 3/12*** | (2006.01) |
| ***B21D 22/02*** | (2006.01) |
| ***C25D 3/56*** | (2006.01) |
| ***C25D 5/36*** | (2006.01) |

(52) U.S. Cl.
CPC ..... *C25D 3/12* (2013.01); *B21D 22/022* (2013.01); *C25D 3/56* (2013.01); *C25D 5/36* (2013.01); *Y10T 428/12611* (2015.01)

(58) Field of Classification Search
None
See application file for complete search history.

(56) References Cited

U.S. PATENT DOCUMENTS

| | | | | |
|---|---|---|---|---|
| 2005/0139291 | A1* | 6/2005 | Taira | C23C 2/26 148/277 |
| 2012/0164472 | A1 | 6/2012 | Kuhn et al. | |
| 2012/0321903 | A1 | 12/2012 | Nakamaru et al. | |
| 2016/0368243 | A1* | 12/2016 | Takahashi | C22C 38/02 |
| 2019/0032236 | A1* | 1/2019 | Hirasawa | B23K 35/3602 |

FOREIGN PATENT DOCUMENTS

| | | | | |
|---|---|---|---|---|
| JP | 2000129487 | A | * | 5/2000 |
| JP | 2004-124207 | A | | 4/2004 |
| JP | 2005-113233 | A | | 4/2005 |
| JP | 2011-246801 | A | | 12/2011 |
| JP | 2012-1816 | A | | 1/2012 |
| JP | 2013-503254 | A | | 1/2013 |

* cited by examiner

*Primary Examiner* — Seth Dumbris
(74) *Attorney, Agent, or Firm* — Birch, Stewart, Kolasch & Birch, LLP

(57) ABSTRACT

The present invention relates to a hot stamped body comprising a steel sheet and a plating layer formed on at least one surface of the steel sheet, wherein the plating layer is comprised of a ZnO region present on a surface side of the plating layer and having an oxygen concentration of 10 mass % or more and an Ni—Fe—Zn alloy region present on a steel sheet side of the plating layer and having an oxygen concentration of less than 10 mass %, and an average concentration of a total of Fe, Mn and Si in the ZnO region is more than 0 mass % and less than 5 mass %.

4 Claims, No Drawings

HOT STAMPED BODY

FIELD

The present invention relates to a hot stamped body. More specifically, the present invention relates to a hot stamped body having improved corrosion resistance on the surface.

BACKGROUND

In recent years, much use has been made of hot stamping (hot pressing) for shaping steel sheet used for automobile members. "Hot stamping" is the method of press-forming a steel sheet in a state heated to a temperature of the austenite region and quenching (cooling) the sheet by the press dies at the same time as shaping. It is one of the methods of shaping steel sheet excellent in strength and dimensional precision. Further, in the steel sheet used for hot stamping, sometimes the surface of the steel sheet is provided with a plating layer such as a Zn—Ni alloy plating layer (for example PTL 1).

In the hot stamped body obtained by hot stamping a plated steel sheet comprised of a steel sheet having a plating layer (also referred to as a "hot pressed member"), corrosion resistance enabling the surface to not corrode due to the surrounding environment (for example, water, etc.) is sought.

In relation to the corrosion resistance of a hot stamped body. PTLs 2 and 3 describe a hot-pressed member comprising a steel sheet, a Ni-diffusion region which is present in a surface layer of the steel sheet, and an intermetallic compound layer and a ZnO layer which are provided in order on the Ni-diffusion region, the inter metallic compound layer corresponding to a γ phase present in a phase equilibrium diagram of a Zn—Ni alloy, wherein a spontaneous immersion potential indicated in a 0.5 M NaCl aqueous air-saturated solution at 25° C.±5° C. is −600 to −360 my based on a standard hydrogen electrode. PTL 2 teaches that if the hot pressed member is provided with the above intermetallic compound layer, excellent corrosion resistance is obtained after coating.

CITATIONS LIST

Patent Literature

[PTL 1] Japanese Unexamined Patent Publication No. 2004.424207

[PTL 2] Japanese Unexamined Patent Publication No, 2011-246801

[PTL 3] Japanese Unexamined Patent Publication No, 2012-1816

SUMMARY

Technical Problem

PTLs 2 and 3 studied the corrosion resistance of the hot pressed member after coating, but did not study the corrosion resistance on the surface of the hot pressed member in the case of not coating the member or the corrosion resistance on the surface of the member before coating. The measures for improvement of the corrosion resistance on the surface in a not coated state were not clear.

Therefore, an object of the present invention is to provide a hot stamped body having improved corrosion resistance on the surface, more specifically improved corrosion resistance on the surface in a not coated state, by a novel constitution.

Solution to Problem

The present inventors discovered that, to achieve this object, in a hot stamped body, it is effective to provide a ZnO region at the surface layer of the plating layer formed on the steel sheet and to control the concentrations of Fe, etc., at the ZnO region to be low. If decreasing the concentrations of Fe, etc., at the ZnO region, it is possible to keep red rust from forming at the surface layer of the hot stamped body and possible to obtain a hot stamped body having improved corrosion resistance on the surface in a state where it is not coated.

The present invention to achieve the above object is as follows:

(1) A hot stamped body comprising a steel sheet and a plating layer formed on at least one surface of the steel sheet, wherein the plating layer is comprised of a ZnO region present on a surface side of the plating layer and having an oxygen concentration of 10 mass % or more and an Ni—Fe—Zn alloy region present on a steel sheet side of the plating layer and having an oxygen concentration of less than 10 mass %, and an average concentration of a total of Fe, Mn and Si in the ZnO region is more than 0 mass % and less than 5 mass %.

(2) The hot stamped body according to (1), wherein a thickness of the ZnO region is 0.5 μm or more and 3.0 μm or less.

(3) The hot stamped body according to (1) or (2), wherein concentrations of Zn, O, Mn and Si in the Ni—Fe—Zn alloy region decrease from the surface side of the plating layer toward the steel sheet side.

(4) The hot stamped body according to any one of (1) to (3), wherein the Ni—Fe—Zn alloy region is comprised of, in order from a surface side of the plating layer, a first region having an Fe concentration of less than 60 mass % and a second region having an Fe concentration of 60 mass % or more, a Zn/Ni mass ratio in the first region is 3.0 or more and 13.0 or less, and an average Zn/Ni mass ratio in the second region is 0.7 or more and 2.0 or less.

(5) The hot stamped body according to (4), wherein the average Zn/Ni mass ratio in the second region is 0.8 or more and 1.2 or less.

Advantageous Effects of Invention

According to the present invention, it is possible to provide a hot stamped body controlled in concentrations of Fe, etc., at a ZnO region present on a surface side of a plating layer of the hot stamped body, kept down in formation of red rust at the surface layer of the body, and having improved corrosion resistance on the surface.

DESCRIPTION OF EMBODIMENTS

<Hot Stamped Body>

The hot stamped body according to the present invention comprises a steel sheet and a plating layer formed on at least one surface of the steel sheet. Preferably, the plating layer is formed on both surfaces of the steel sheet.

[Steel Sheet]

The chemical composition of the steel sheet of the present invention is not particularly limited and may be determined considering the strength of the hot stamped body after hot stamping and the hardenability at the time of hot stamping.

Below, elements able to be contained in the steel sheet in the present invention will be explained. The "%" showing the contents of the elements in the chemical composition means mass % unless otherwise indicated.

Preferably, the steel sheet in the present invention can contain, by mass %, C: 0.05% or more and 0.70% or less, Mn: 0.5% or more and 11.0% or less, Si: 0.05% or more and 2.50% or less, Al: 0.001% or more and 1.500% or less, P: 0.100% or less, S: 0.100% or less, N: 0.010% or less, and O: 0.010% or less.

(C: 0.05% or More and 0.70% or Less)

C (carbon) is an element effective for improving the strength of the steel sheet. Automobile members, for example, sometimes require high strengths of 980 MPa or more. To sufficiently secure strength, the C content is preferably 0.05% or more. On the other hand, if excessively containing C, sometimes the workability of the steel sheet falls, therefore the C content is preferably 0.70% or less. The lower limit of the C content is preferably 0.10%, more preferably 0.12%, still more preferably 0.15%, most preferably 0.20%. Further, the upper limit of the C content is preferably 0.65%, more preferably 0.60%, still more preferably 0.55%, most preferably 0.50%.

(Mn: 0.5% or More and 11.0% or Less)

Mn (manganese) is an element effective for improving the hardenability at the time of hot stamping, To reliably obtain this effect, the Mn content is preferably 0.5% or more. On the other hand, if excessively containing Mn, the Mn segregates and the strength, etc., of the body after hot stamping are liable to become uneven, therefore the Mn content is preferably 11.0% or less. The lower limit of the Mn content is preferably 1.0%, more preferably 2.0%, still more preferably 2.5%, even still more preferably 3.0%, most preferably 3.5%. The upper limit of the Mn content is preferably 10.0%, more preferably 9.5%, still more preferably 9.0%, even still more preferably 8.5%, most preferably 8.0%.

(Si: 0.05% or More and 2.50% or Less)

Si (silicon) is an element effective for improving the strength of the steel sheet. To sufficiently secure the strength, the Si content is preferably 0.05% or more. On the other hand, if excessively containing Si, the workability sometimes falls, therefore the Si content is preferably 2.50% or less. The lower limit of the Si content is preferably 0.10%, more preferably 0.15%, still more preferably 0.20%, most preferably 0.30%. The upper limit of the Si content is preferably 2.00%, more preferably 1.80%, still more preferably 1.50%, most preferably 1.20%.

(Al: 0.001% or More and 1.500% or Less)

Al (aluminum) is an element acting as a deoxidizing element. To obtain the effect of deoxidation, the Al content is preferably 0.001% or more. On the other hand, if excessively containing Al, the workability is liable to fall, therefore the Al content is preferably 1,500% or less. The lower limit of the Al content is preferably 0.010%, more preferably 0.020%, still more preferably 0.050%, most preferably 0.100%. The upper limit of the Al content is preferably 1.000%, more preferably 0.800%, still more preferably 0.700%, most preferably 0.500%.

(P: 0.100% or Less)

(S: 0.100% or Less)

(N: 0.010% or Less)

(O: 0.010% or Less)

P (phosphorus), S (sulfur), N (nitrogen), and O (oxygen) are impurities. The less the better, therefore the lower limits of these elements are not particularly prescribed. However, the contents of these elements may also be more than 0.000% or 0.001% or more. On the other hand, if excessively containing these elements, the toughness, ductility, and/or workability are liable to deteriorate, therefore preferably the upper limits of P and S are 0.100% and the upper limits of N and O are 0.010%. The upper limits of P and S are preferably 0.080%, more preferably 0.050%. The upper limits of N and O are preferably 0.008%, more preferably 0.005%.

The basic chemical composition of the steel sheet in the present invention is as explained above. Furthermore, the steel sheet may, in accordance with need, contain at least one of the following optional elements in place of part of the balance of Fe. For example, the steel sheet may contain B: 0% or more and 0.0040%. Further, the steel sheet may contain Cr: 0% or more and 2.00% or less. Further, the steel sheet may contain at least one element selected from the group consisting of Ti: 0% or more and 0.300% or less, Nb: 0% or more and 0.300% or less, V: 0% or more and 0.300% or less, and Zr: 0% or more and 0.300% or less. Further, the steel sheet may contain at least one element selected from the group consisting of Mo: 0% or more and 2.000% or less, Cu: 0% or more and 2.000% or less, and 0% or more and 2.000% or less. Further, the steel sheet may contain Sb: 0% or more and 0,100% or less. Further, the steel sheet may contain at least one element selected from the group consisting of Ca: 0% or more and 0.0100% or less, Mg: 0% or more and 0.0100% or less, and REM: 0% or more and 0.1000% or less. Below, these optional elements will be explained in detail.

(B: 0% or More and 0.0040% or Less)

B (boron) is an element effective for improving the hardenability at the time of hot stamping. The B content may be 0%, but to reliably obtain this effect, the B content is preferably 0.0005% or more. On the other hand, if excessively containing B, the workability of the steel sheet is liable to fall, therefore the B content is preferably made 0.0040% or less. The lower limit of the B content is preferably 0.0008%, more preferably 0.0010%, still more preferably 0.0015%. Further, the upper limit of the B content is preferably 0.0035%, more preferably 0.0030%.

(Cr: 0% or More and 2.00% or Less)

Cr (chromium) is an element effective for improving the hardenability at the time of hot stamping. The Cr content may be 0%, but to reliably obtain this effect, the Cr content is preferably 0.01% or more. The Cr content may also be 0.10% or more, 0.50% or more, or 0.70% or more. On the other hand, if excessively containing Cr, the thermal stability of the steel material sometimes falls. Therefore, the Cr content is preferably 2.00% or less. The Cr content may also be 1.50% or less, 1.20% or less, or 1.00% or less.

(Ti: 0% or More and 0.300% or Less)

(Nb: 0% or More and 0.300% or Less)

(V: 0% or More and 0.300% or Less)

(Zr: 0% or More and 0.300% or Less)

Ti (titanium), Nb (niobium), V (vanadium), and Zr (zirconium) are elements improving the tensile strength through refinement of the metal structure. The contents of these elements may be 0%, but to reliably obtain their effects, the Ti, Nb, V, and Zr contents are preferably 0.001% or more and may be 0.010% or more, 0.020% or more, or 0.030% or more as well. On the other hand, if excessively containing Ti, Nb, V, and Zr, the effects become saturated and the production costs rise. For this reason, the Ti, Nb, V, and Zr contents are preferably 0.300% or less and may be 0.150% or less, 0.100% or less, or 0.060% or less as well.

(Mo: 0% or More and 2.000% or Less)

(Cu: 0% or More and 2.000% or Less)

(Ni: 0% or More and 2.000% or Less)

Mo (molybdenum), Cu (copper), and Ni (nickel) have actions raising the tensile strength. The contents of these elements may be 0%, but to reliably obtain their effects, the Mo, Cu, and Ni contents are preferably 0.001% or more and may be 0.010% or more, 0.050% or more, or 0.100% or more as well. On the other hand, if excessively containing Mo, Cu, and Ni, sometimes the thermal stability of the steel material falls. Therefore, the Mo, Cu, and Ni contents are preferably 2.000% or less and may be 1,500% or less, 1.000% or less, or 0.800% or less.

(Sb: 0% or More and 0.100% or Less)

Sb (antimony) is an element effective for improving the wettability and adhesion of plating. The Sb content may also be 0%, but to reliably obtain this effect, the Sb content is preferably 0.001% or more. The Sb content may also be 0.005% or more, 0.010% or more, or 0.020% or less. On the other hand, if excessively containing Sb, sometimes a drop in the toughness is triggered. Therefore, the Sb content is preferably 0.100% or less. The Sb content may also be 0.080% or less, 0.060% or less, or 0.050% or less.

(Ca: 0% or More and 0.0100% or Less)

(Mg: 0% or More and 0.0100% or Less)

(REM: 0% or More and 0.1000% or Less)

Ca (calcium), Mg (magnesium), and REM (rare earth metals) are elements improving the toughness after hot stamping by adjusting the shapes of the inclusions. The contents of these elements may also be 0%, but to reliably obtain their effects, the Ca, Mg, and REM contents are preferably 0.0001% or more and may be 0.0010% or more, 0.0020% or more, or 0.0040% or more as well. On the other hand, if excessively containing Ca, Mg, and REM, the effects becomes saturated and the production costs rise. For this reason, the Ca and Mg contents are preferably 0.0100% or less and may be 0.0080% or less, 0.0060% or less, or 0.0050% or less as well. Similarly, the REM content is preferably 0.1000% or less and may be 0.0800% or less, 0.0500% or less, or 0.0100% or less as well.

The balance other than the above elements consists of iron and impurities. Here, the "impurities" include constituents entering during various factors in the production process such as the ore, scrap, or other raw materials when industrially producing the steel sheet and not intentionally added to the steel sheet according to the embodiments of the present invention. Further, the "impurities" include elements which are other than the constituents explained above and which are contained in the steel sheet at a level where the actions and effects unique to the elements do not affect the properties of the hot stamped body according to the embodiments of the present invention.

The steel sheet in the present invention is not particularly limited. Hot rolled steel sheet, cold rolled steel sheet, and other general steel sheet can be used. Further, the steel sheet in the present invention may be any thickness so long as enabling formation of the later explained Zn—Ni plating layer on the steel sheet and the hot stamping. For example, it may be 0.1 to 3.2 mm.

[Plating Layer]

The plating layer of the hot stamped body according to the present invention is comprised of a ZnO region and an Ni—Fe—Zn alloy region. The "ZnO region" means a region present on the surface side of the plating layer and having an oxygen concentration of 10 mass % or more. The remaining region of the plating layer is the Ni—Fe—Zn alloy region, i.e., the Ni—Fe—Zn alloy region means a region present on the steel sheet side of the plating layer and having an oxygen concentration of less than 10%. Therefore, the ZnO region and the Ni—Fe—Zn alloy region are present in a contiguous manner. The two regions form the plating layer, in the plating layer in the present invention, oxygen is taken into the plating layer at the time of hot stamping, therefore the surface side of the plating layer becomes highest in oxygen concentration. The oxygen concentration decreases the further to the steel sheet side, Therefore, the part from the surface of the hot stamped body to the position where the oxygen concentration becomes 10 mass % is the ZnO region, while the remaining part of the plating layer becomes the Ni—Fe—Zn alloy region.

The plating layer of the hot stamped body according to the present invention, for example, can be obtained by forming a Zn—Ni alloy plating layer on a steel sheet, further forming an Ni plating layer on top of that, then hot stamping the sheet in a 5 to 25% oxygen atmosphere, for example, an air atmosphere. Therefore, the constituents able to be contained in the Zn—Ni plating layer or Ni plating layer in the present invention are, in addition to the elements contained in the plating layer before the hot stamping (typically Zn and Ni), elements contained in the steel sheet 1.5 (for example, Fe, Mn, Si, etc.) and also O taken in at the time of the hot stamping. The balance consists of impurities. Here, the "impurities" include not only elements which unavoidably enter in the production process, but also elements intentionally added in a range where the corrosion resistance of the hot stamped body according to the present invention is not obstructed.

The concentrations of the constituents in the plating layer in the present invention are measured by quantitative analysis glow discharge spectroscopy (GDS). By quantitatively analyzing the plating layer from the surface in the depth direction using GDS, the distributions of concentration of the different constituents in the sheet thickness direction are quantitatively identified. Therefore, by measuring the distribution of concentration of oxygen of the plating layer using GDS and identifying the position where the oxygen concentration becomes 10 mass %, it is possible to differentiate a ZnO region and an Ni—Fe—Zn alloy region. The measurement conditions of the GDS may be a measurement size of 4 mmφ, Ar gas pressure: 600 Pa, electric power: 35 W, and measurement time period: 100 seconds. The apparatus used may be a GD-profiler 2 made by Horiba, Ltd.

The thickness of the plating layer in the present invention may, for example, be 3.0 μm or more and 20.0 μm or less per surface. Further, the ratio of the thickness accounted for by the ZnO region in the plating layer is not particularly limited, but from the viewpoint of securing the corrosion resistance of the hot stamped body and preventing deterioration of the appearance due to formation of an uneven surface, 1% or more and 15% or less is preferable and 2% or more and 12% or less is more preferable. The thickness of the plating layer can, for example, be measured by examining a cross-section of the hot stamped body according to the present invention by a scan type electron microscope (SEM). Further, it can also be measured by identifying the region of the plating layer from elemental analysis by quantitative analysis GDS and conversion to thickness.

(ZnO Region)

In the hot stamped body according to the present invention, the plating layer has a ZnO region having an oxygen concentration of 10 mass % or more at the surface side of that plating layer. That ZnO region is typically a region where the Zn in the Zn—Ni alloy plating layer which had been formed before the hot stamping and the 0 in the atmosphere at the time of the hot stamping bond together, i.e., where Zn is oxidized and becomes ZnO. In the present invention, in the plated steel sheet before the hot stamping, there is an Ni plating layer on the Zn—Ni plating layer, but the relatively easily oxidizable Zn is pulled to the 0 in the atmosphere at the time of hot stamping and in that way can diffuse through the Ni plating layer to reach the surface and form a ZnO region.

Depending on the conditions of the hot stamping, at the time of the heating for hot stamping, sometimes the constituents of the steel sheet, i.e., the Fe, Mn, Si, etc., will diffuse into the plating layer. If such elements, in particular Fe, diffuse in the ZnO region of the surface layer of the hot stamped body in large amounts, the Fe of the surface layer will be liable to corrode resulting in the formation of red rust due to the surrounding environment (for example, water). Therefore, in the plated steel sheet used for obtaining the hot stamped body according to the present invention, in addition to the Zn—Ni plating layer on the steel sheet, an Ni plating layer able to suppress diffusion of the Fe and other constituents in the steel sheet is provided on that. Due to the presence of this Ni plating layer, a ZnO region of a desired thickness is formed at the surface layer of the hot stamped body obtained after hot stamping while it becomes difficult for constituents derived from the steel sheet to diffuse into the ZnO region, i.e., the average concentration of the total of Fe, Mn and Si in the ZnO region is kept low. Therefore, it becomes possible to effectively suppress the formation of red rust and obtain a hot stamped body having improved corrosion resistance on the surface. To obtain sufficient corrosion resistance on the surface, in the ZnO region in the present invention, the average concentration of the total of Fe, Mn and Si has to be more than 0 mass % and less than 5 mass %. In the present invention, it is sufficient that the average concentration of the total of Fe, Mn and Si in the ZnO region be in the above range, but the less the amount of Fe, which is a particularly main cause of red rust, the better. Therefore, preferably, in the plating layer in the present invention, Fe: 0 mass % or more and 1 mass % or less, Mn: 0 mass % or more and 2 mass % or less, and Si: 0 mass % or more and 2 mass % or less are contained. The average concentration of the total of these elements is preferably 4 mass % or less, more preferably 3 mass % or less, still more preferably 2 mass % or less.

The "average concentration of the total of Fe, Mn and Si" is found by equally dividing the region having an oxygen concentration of greater than or equal to 10% identified by quantitative analysis GDS (i.e., the ZnO region) into 10 sections, reading the Fe concentrations, Mn concentrations, and Si concentrations of the center positions of the sections from the GDS results, finding the totals of the concentrations of these elements at the sections, and averaging the obtained 10 totals of Fe, Mn and Si.

As explained above, at the surface side of the plated steel sheet used for obtaining the hot stamped body according to the present invention, an Ni plating layer is provided. Therefore, diffusion of Zn from the Zn—Ni plating layer underneath that can be suppressed somewhat by the Ni plating layer. For this reason, the thickness of the ZnO region in the present invention is for example sometimes 3.0 μm or less. If the thickness of the ZnO region is 3.0 μm or less, unevenness due to oxides dropping off from the surface layer of the hot stamped body, etc., is prevented and a hot stamped body excellent in surface appearance can be obtained. If this thickness becomes more than 3.0 μm, the oxides of the surface layer of the plating layer become brittle and drop off resulting in the formation of unevenness and are liable to cause a degraded appearance. Not only this, the dropped off oxides are liable to harm the press dies. On the other hand, to make the thickness of the ZnO region less than 0.5 μm, it is necessary to make the Ni plating layer of the plated steel sheet thicker. This is not preferable cost-wise. Therefore, the lower limit of the thickness of the ZnO region may be 0.5 μm. The lower limit of the thickness of the ZnO region is preferably 0.7 μm, more preferably 1.0 μm, still more preferably 1.2 μm. Further, the upper limit of the thickness of the ZnO region is preferably 2.8 μm, more preferably 2.5 μm, still more preferably 2.2 μm.

The ZnO region typically is higher in Zn concentration compared with the Ni concentration. For example, the Zn/Ni mass ratio at the ZnO region is 5.0 or more. "The Zn/Ni mass ratio at the ZnO region is 5.0 or more" means the mass ratio of Zn/Ni is 5.0 or more at all positions in the ZnO region. In the present invention, it is possible to equally divide the ZnO region into 10 sections, read the Zn concentrations and Ni concentrations of the center positions of the sections from the GDS results, find the Zn/Ni mass ratios of the sections, and judge if the obtained 10 Zn/Ni mass ratios are all 5.0 or more. The Zn/Ni mass ratio at the ZnO region is preferably 5.5 or more, more preferably 6.0 or more, still more preferably 7.0 or more. The upper limit of the Zn/Ni mass ratio of that region is not particularly limited, but, for example, may be 30.0 or 20.0.

Zn is present in a greater amount compared with Ni in the ZnO region of the hot stamped body in this way because at the time of the hot stamping in an oxygen atmosphere, among the Ni and Zn in the plating layer before the hot stamping, the Zn, which is more easily oxidized compared with the Ni, is oxidized by the 0 in the hot stamping atmosphere and forms ZnO. Zn can pass through the Ni plating layer and diffuse to the surface to form ZnO due to its easy oxidizability. Ni also diffuses somewhat from the Zn—Ni plating layer and Ni plating layer. If the Zn/Ni mass ratio is 5.0 or more, a large amount of the oxides ZnO are present at the surface layer of the hot stamped body, therefore the corrosion resistance on the surface of the hot stamped body is improved. If the Zn/Ni mass ratio at the ZnO region is less than 5.0, ZnO is not sufficiently formed at the surface layer, therefore the corrosion resistance on the surface is liable to become insufficient.

The concentrations of the constituents contained in the ZnO region in the present invention, as explained above, are determined by quantitative analysis GDS. Under the same conditions as the above-mentioned GDS conditions, as the elements covered, at least Zn, Ni, O, Fe, Si, and Mn are designated and measured. Further, the thickness of the ZnO region can be determined by identifying the range of oxygen concentration equal to or greater than 10 mass % by quantitative analysis GDS and measuring that depth.

(Ni—Fe—Zn Alloy Region)

The hot stamped body according to the present invention has an Ni—Fe—Zn alloy region at the steel sheet side of the plating layer which is contiguous with the above-mentioned ZnO region and which has an oxygen concentration of less than 10 mass %. Preferably, that alloy region has Zn, Ni, O, Fe, Mn and Si present in it. That Ni—Fe—Zn alloy region typically is a region formed by the Fe in the steel sheet diffusing into the plating layer at the time of the heating in the hot stamping whereby the Zn and Ni in the Zn—Ni plating layer and the Ni in the Ni plating layer before the hot stamping and the Fe diffusing from inside the steel sheet become alloyed. Further, the Mn and Si in the steel sheet sometimes also diffuse in the Ni—Fe—Zn alloy region simultaneously with the Fe and are alloyed.

In the Ni—Fe—Zn alloy region in the present invention, the concentrations of Zn, O, Mn and Si preferably decrease from the surface side of the plating layer toward the steel sheet side. In other words, in that alloy region, the Fe concentration preferably increases from the surface side of the plating layer toward the steel sheet side. "The concentrations of Zn, O, Mn and Si preferably decrease from the surface side of the plating layer toward the steel sheet side" means that in the Ni—Fe—Zn alloy region, the concentrations of these elements steadily decrease from the surface side of the plating layer toward the steel sheet side, i.e., in each of the elements listed, when measuring the concentrations at any two positions by GDS, etc., among the two positions, the position closer to the surface side of the plating layer is higher in concentration compared with the other positions. The "decrease" referred to here means the concentrations of Zn, O, Mn and Si steadily decrease. Linearity is not a concern. In the case of Ni alone, there is a maximum value of concentration somewhat at the steel sheet side from the surface. If the plating layer of the hot stamped body according to the present invention is formed with an ZnO region and Ni—Fe—Zn alloy region, typically it will often have such a distribution of concentration. Therefore, Ni—Fe—Zn alloy region may be comprised of, in order from a surface side of the plating layer, a first region having an Fe concentration of less than 60 mass % and a second region having an Fe concentration of 60 mass % or more. The first region and the second region in the Ni—Fe—Zn alloy region can be differentiated by measuring the Fe concentrations by quantitative analysis GDS.

The Ni—Fe—Zn alloy region is a region at the steel sheet side of the plating layer. Typically, at the time of the hot stamping, the Zn which had been contained in the Zn—Ni plating layer before the hot stamping diffuses into the steel sheet. This diffusion occurs more remarkably the closer to the steel sheet. For this reason, in that alloy region, sometimes the concentration of Zn decreases from the surface side of the plating layer toward the steel sheet side. Further, oxygen typically is contained in the atmosphere at the time of the hot stamping, therefore decreases in concentration in the plating layer of the hot stamped body the further from the surface side of the plating layer toward the steel sheet side. Furthermore, Mn and Si are elements present in the steel sheet before the hot stamping, but by the hot stamping in an oxygen atmosphere, due to their ease of oxidation, these can diffuse at the surface side of the plating layer more preferentially compared with Fe. Accordingly, in the alloy region, the concentrations of Mn and Si sometimes decrease from the surface side of the plating layer toward the steel sheet side.

In the present invention, the Zn/Ni mass ratio in the first region of the Ni—Fe—Zn alloy region is preferably a range of 3.0 or more and 13.0 or less. More preferably, in the first region, the Zn/Ni mass ratio continuously changes in the range of 3.0 or more and 13.0 or less from the surface side to the steel sheet side of the plating layer. The "Zn/Ni mass ratio in the first region is preferably a range of 3.0 or more and 13.0 or less" means the Zn/Ni mass ratio is within a range of 3.0 or more and 13.0 or less at all positions in the first region. In the present invention, it is possible to equally divide the first region into 10 sections, read the Zn concentrations and Ni concentrations of the center positions of the sections from the GDS results, find the Zn/Ni mass ratios of the sections, and judge if the obtained 10 Zn/Ni mass ratios are all 3.0 or more and 13.0 or less. If the Zn/Ni mass ratio at the first region is the above range, a sufficient amount of Zn can be secured at that region and furthermore a sufficient amount of Zn can be obtained at other regions. For this reason, even if the plating layer of the hot stamped body is scratched, the Zn present at that region will be oxidized to ZnO and an oxide coating film will be formed (called "sacrificial anticorrosive action") whereby the scratched part can be kept from corroding and the corrosion resistance in scratches of the hot stamped body can be improved. If the Zn/Ni mass ratio in the first region becomes less than 3.0, the sacrificial anticorrosive action of Zn cannot be sufficiently exhibited and the corrosion resistance in scratches is liable to become insufficient. On the other hand, if more than 13.0, the corrosion resistance in scratches of the hot stamped body as a whole is liable to become insufficient since the Zn in other regions, for example, the surface layer part of the plating layer and/or the second region, can become insufficient. The lower limit of the Zn/Ni mass ratio in the first region is preferably 3.5, more preferably 4.0, while the upper limit is preferably 12.0, more preferably 11.0, still more preferably 10.0.

In the present invention, the average Zn/Ni mass ratio in the second region is preferably 0.7 or more and 2.0 or less. As explained above, the Zn in the Zn—Ni plating layer which had been formed before the hot stamping diffuses into the surface side of the plating layer and into the steel sheet at the time of hot stamping, but in the hot stamped body according to the present invention, a predetermined amount of Zn remains at the second region of the Ni—Fe—Zn alloy region contiguous with the steel sheet. If Zn remains in the above range in that second region, even if the plating layer or further the underlying steel sheet is scratched, the sacrificial anticorrosive action of the Zn can be exhibited, therefore the corrosion resistance in scratches can be improved. If the average Zn/Ni mass ratio in the second region is less than 0.7, the sacrificial anticorrosive action of the Zn cannot be sufficiently exhibited and the corrosion resistance in scratches is liable to become insufficient. On the other hand, if more than 2.0, Zn is liable to not sufficiently diffuse at the surface layer part of the plating layer and/or Zn is liable to become insufficient in the first region and the corrosion resistance in scratches of the hot stamped body as a whole is liable to become insufficient. The average Zn/Ni mass ratio in the second region is preferably 0.8 or more. Further, the average Zn/Ni mass ratio in the second region is preferably 1.8 or less, more preferably 1.5 or less, still more preferably 1.2 or less. Therefore, most preferably the average Zn/Ni mass ratio in the second region is 0.8 or more and 1.2 or less.

The "average Zn/Ni mass ratio in the second region" can be found by equally dividing the region with an Fe concentration of the Ni—Fe—Zn alloy region equal to or greater than 60% (second region) into 10 sections, reading the Zn concentrations and Ni concentrations of the center positions of the sections from the GDS results, finding the Zn/Ni mass ratios of the sections, and averaging the obtained 10 Zn/Ni mass ratios.

The thickness of the Ni—Fe—Zn alloy region can be determined by identifying the range of oxygen concentration less than 10 mass % by quantitative analysis GDS and measuring the thickness. Further, similarly, the thicknesses of the first region (Fe concentration less than 60 mass %) and the second region (Fe concentration equal to or greater than 60 mass %) of the Ni—Fe—Zn alloy region can be determined from the Fe concentration obtained by GDS.

<Method of Production of Hot Stamped Body>

An example of the method of production of the hot stamped body according to the present invention will be explained next. The hot stamped body according to the present invention can be obtained by forming on at least one surface, preferably both surfaces, of a steel sheet, for example, in order, a Zn—Ni plating layer and Ni plating layer by electroplating to obtain a plated steel sheet and hot stamping the obtained plated steel sheet under predetermined conditions. The obtained hot stamped body has on its steel sheet a plating layer comprised of, in order from the surface side, a ZnO region having an oxygen concentration of 10 mass % or more and an Ni—Fe—Zn alloy region having an oxygen concentration of less than 10 mass %. The ZnO region is formed by the bonding of the oxygen contained in the atmosphere at the time of hot stamping and the Zn in the Zn—Ni plating layer diffusing through the Ni plating layer and reaching the surface. On the other hand, the Ni—Fe—Zn alloy region is formed by alloying of the Fe diffusing into the plating layer from the steel sheet at the time of hot stamping with the Zn and Ni in the Zn—Ni plating layer and Ni plating layer.

(Production of Steel Sheet)

The method of production of the steel sheet used for producing the hot stamped body according to the present invention is not particularly limited. For example, it is possible to adjust the molten steel in chemical composition to the desired ranges, hot roll it, coil it, and further cold roll it to obtain a steel sheet. The thickness of the steel sheet in the present invention may, for example, be 0.1 mm to 3.2 mm.

The chemical composition of the steel sheet used is not particularly limited, but as explained above, the steel sheet preferably contains, by mass %, C: 0.05% or more and 0.70% or less, Mn: 0.5% or more and 11.0% or less, Si: 0.05% or more and 2.50% or less, Al: 0.001% or more and 1.500% or less, P: 0.100% or less, S: 0.100% or less, N: 0.010% or less, O: 0.010% or less, and B: 0.0005% or more and 0.0040% or less and has a balance of iron and impurities.

(Formation of Plating Layer)

The method of formation of the Zn—Ni plating layer and the Ni plating layer is not particularly limited, but the layers are preferably formed by electroplating. However, the invention is not limited to electroplating. Thermal spraying, vapor deposition, etc., can also be used. Below, the case of forming the Zn—Ni plating layer and Ni plating layer by electroplating will be explained.

Regarding the Zn—Ni plating layer on the steel sheet formed by the electroplating, as the plating deposition amount, for example, 25 g/m$^2$ or more and 90 g/m$^2$ or less per surface is preferable, while 30 g/m$^2$ or more and 50 g/m$^2$ or less is more preferable. The Zn/Ni ratio of the Zn—Ni plating layer may be for example, 3.0 or more and 20.0 or less and is preferably 4.0 or more and 10.0 or less. If the Zn/Ni ratio is too small, the concentration of Zn remaining in the plating layer of the hot stamped body will become insufficient, the sacrificial anticorrosive action will not be sufficiently obtained, and the corrosion resistance in scratches is liable to become insufficient. On the other hand, if the Zn/Ni ratio is more than 20.0, the melting point of the Zn—Ni plating layer will drop, etc., causing accelerated diffusion of Zn from that Zn—Ni plating layer and further, along with that, accelerated diffusion of Fe and other constituents in the steel sheet resulting sometimes in the ZnO region becoming too thick or the average concentration of the total of Fe, Mn and Si in the ZnO region becoming too high. In such a case, the oxides of the surface layer of the finally obtained plating layer will become brittle and drop off resulting in the formation of unevenness and will cause a degraded appearance or the Fe, etc., of the surface layer are liable to corrode and form red rust due to the surrounding environment. Further, the composition of the bath used for forming the Zn—Ni plating layer may, for example, be nickel sulfate hexahydrate: 25 to 350 g/liter, zinc sulfate heptahydrate: 10 to 150 g/liter, and sodium sulfate: 25 to 75 g/liter. Further, the current density may be 10 to 100 A/dm$^2$. The bath composition and the current density can be suitably adjusted so that the desired plating deposition amount and Zn/Ni ratio are obtained. The bath temperature and bath pH may be suitably adjusted so that plating burns do not occur. For example, they may be respectively 40 to 70° C. and 1.0 to 3.0.

Further, the Ni plating layer on the steel sheet formed by electroplating preferably has an amount of plating deposition of, for example, 0.3 g/m$^2$ or more and 15.0 g/m$^2$ or less per surface, more preferably 0.5 g/m$^2$ or more and 10.0 g/m$^2$ or less. By forming an Ni plating layer of such a range of amount of plating deposition, the Ni plating layer becomes a barrier keeping the constituents derived from the steel sheet from diffusing into the ZnO region of the surface layer of the hot stamped body at the time of hot stamping and enabling a desired average concentration of the total of Fe, Mn and Si in the Zoo) region to be obtained. If the amount of plating deposition of the Ni plating layer becomes less than 0.3 g/m$^2$, the barrier function is not sufficiently realized and large amounts of Fe, etc., are liable to diffuse into the ZnO region. On the other hand, if more than 5.0 g/m$^2$, diffusion of the Zn of the Zn—Ni plating layer to the surface layer will be excessively suppressed and the thickness of the ZnO region is liable to become insufficient. Further, this is not preferable cost-wise. The composition of the bath used for forming the Ni plating layer may for example be a strike bath or a watt bath. Further, the current density may be 5 to 50 A/dm$^2$. The bath temperature and the bath pH may be suitably adjusted so that plating burns do not occur. For example, they may respectively be 40 to 70° C. and 1.0 to 3.0.

The amount of plating deposition and Zn/Ni ratio of the Zn—Ni plating layer and the amount of plating deposition of the Ni plating layer are interrelated with the diffusion of the constituents of the steel sheet from the steel sheet to the plating layer and the formation of the ZnO region, etc. For this reason, by just controlling the values of the parameters to within the above ranges, sometimes the desired configuration of the plating layer cannot be obtained. For example, even if the amount of plating deposition of the Ni plating layer is within the above range, if the Zn/Ni ratio of the Zn—Ni plating layer is relatively large, the melting point of the Zn—Ni plating layer will drop, etc., causing accelerated diffusion of Zn from the Zn—Ni plating layer and the accompanying diffusion of Fe and other constituents in the steel sheet whereby the Ni plating layer will not necessarily be able to exert a sufficient barrier function and excessive formation of the ZnO region and/or an increase in the average concentration of the total of Fe, Mn and Si in the ZnO region will sometimes be invited. In addition, diffusion of these elements is greatly affected by the heating temperature and holding time in the later explained hot stamping. Therefore, even with the same amount of plating deposition and Zn/Ni ratio of the Zn—Ni plating layer and amount of plating deposition of the Ni plating layer, the features of the finally obtained plating layer can change in accordance with the heating temperature, rate of temperature rise, holding time, etc., at the time of hot stamping. For this reason, to obtain the desired configuration of the plating layer, the specific values of the amount of plating deposition and Zn/Ni ratio of the Zn—Ni plating layer and amount of plating deposition of the Ni plating layer have to be suitably selected considering the interrelationship of these parameters and the conditions of the hot stamping, etc.

The methods of measurement of the amount of plating deposition and Zn/Ni ratio of the Zn—Ni plating layer formed and amount of plating deposition of the Ni plating layer are not particularly designated, but for example can be measured by SEM/EDX (scan electron microscope/energy dispersive X-ray spectroscopy) from a cross-section of the steel sheet on which the Zn—Ni plating layer and Ni plating layer are formed.

(Hot Stamping)

Next, the steel sheet formed with the Zn—Ni plating layer and Ni plating layer is hot stamped. The heating temperature of the hot stamping need only enable the steel sheet to be heated to the temperature of the austenite region. For example, it is 800° C., or more and 1000° C. or less, preferably 850° C. or more and 950° C. or less. If the heating temperature of the hot stamping becomes higher, constituents derived from the steel sheet will more easily diffuse and excessive Fe, etc., are liable to diffuse to the ZnO region. The heating system of the hot stamping is not limited, but for example, furnace heating, ohmic heating, induction heating, etc., may be mentioned. The holding time after heating can be suitably set to 0.5 minute or more and 5.0 minutes or less, more preferably 1.0 minute or more and 4.0 minutes or less, still more preferably 1.0 minutes or more and 2.0 minutes or less. If the holding time is too long, large amounts of Fe and other steel sheet constituents are liable to diffuse to the surface layer of the hot stamped body and/or the ZnO region is liable to become too thick. The atmosphere of the hot stamping is preferably a 5 to 25% oxygen atmosphere. For example, it can be the air atmosphere. Further, after the heating treatment, the body can be cooled (quenched) by a cooling rate of 10 to 100° C./s.

The plated steel sheet for obtaining the hot stamped body according to the present invention is formed with an Ni plating layer on its surface, therefore it becomes possible to use that Ni plating layer to prevent to some extent the diffusion of the Zn in the underlying Zn—Ni plating layer into the surface layer. Even if hot stamping in an air atmosphere, it is possible to prevent the ZnO region of the surface layer of the hot stamped body obtained from becoming excessively thick. Therefore, it becomes possible to easily obtain a relatively thin ZnO region without more than the necessary control of the dew point in the atmosphere at the time of hot stamping or other control of the internal furnace environment. Control at the time of hot stamping is simplified.

By suitably adjusting the amount of deposition of the Zn—Ni plating layer and Zn/Ni ratio before the hot stamping, the amount of Ni plating deposition, and the hot stamping conditions (for example, temperature, holding time, oxygen concentration in atmosphere, etc.), it is possible to form the ZnO region and Ni—Fe—Zn alloy region, more specifically the ZnO region and the first region and the second region of the Ni—Fe—Zn alloy region, and adjust the concentrations of the elements and thicknesses of the respective regions.

EXAMPLES

The hot stamped body according to the present invention will be explained in more detail below while giving several examples. However, it is not intended that the scope of the invention described in the claims be limited by the specific examples explained below.

(Formation of Plated Steel Sheet)

A thickness 1.4 mm cold rolled steel sheet was dipped in a plating bath having the following plating bath composition (Zn—Ni plating) and electroplated to form a Zn—Ni plating layer on both surfaces of that cold rolled steel sheet. The pH of this plating bath was 2.0, the bath temperature was maintained at 60° C., and the current density was 50 A/dm$^2$. Next, the steel sheet which the Zn—Ni plating layer was formed was dipped in a plating bath (strike bath) having the following plating bath composition (Ni plating) and formed with an Ni plating layer on the Zn—Ni plating layer by electroplating to obtain the plated steel sheet used for hot stamping explained later. The pH of this plating bath was 1.5, the bath temperature was maintained at 50° C., and the current density was 20 A/dm$^2$. All of the steel sheets used contained, by mass %, C: 0.50%, Mn: 3.0%, Si: 0.50%, Al: 0,100%, P: 0.010%, S: 0.020%, N: 0.003%, O: 0.003%, and B: 0.0010% and had a balance of iron and impurities.

Plating Bath Composition (Zn—Ni Plating)
nickel sulfate hexahydrate: 25 to 250 g/liter (variable)
zinc sulfate heptahydrate: 10 to 150 g/liter (variable)
sodium sulfate: 50 g/liter (fixed)
Plating bath composition (Ni plating)
nickel chloride: 240 g/liter (fixed)
hydrochloric acid: 125 ml/liter (fixed)

To obtain the desired amount of plating deposition and Zn/Ni ratio in the Zn—Ni plating layer, the plating bath composition (the concentrations of the nickel sulfate hexahydrate and zinc sulfate heptahydrate), current density, and conduction time were adjusted. Further, to obtain the desired amount of plating deposition in the Ni plating layer, the current density and conduction time were adjusted. The amount of plating deposition (g/m$^2$) and Zn/Ni ratio in the Zn—Ni plating layer on the steel sheet obtained by electroplating and the amount of plating deposition (g/m$^2$) in the Ni plating layer were measured by SEM-EDX from a cross-section of the plated steel sheet. The results of these measurements are shown in Table 1. The amount of plating deposition shows the amount of deposition per single surface.

(Hot Stamping)

Next, the obtained plated steel sheet was hot stamped under the conditions shown in Table 1. The heating was performed by furnace heating. For the shaping, 90 degree V-dies were used. Further, the quenching was performed by a cooling rate of 30° C./s. Everything was performed in an air atmosphere.

(Quantitative Analysis GDS of Plating Layer)

The elements contained in the plating layer of each sample obtained after the hot stamping were measured using a GD-profiler 2 made by Horiba, Ltd. by quantitative analysis GDS. The measurement conditions of the GDS were made a measurement size of 4 mmφ, Ar gas pressure: 600 Pa, electric power: 35 W, and measurement time period: 100 seconds. The measured elements were Zn, Ni, Fe, Mn, Si, and O, Specifically, first, the sample was divided into a region having an oxygen concentration of 10 mass % or more by GDS and a region having an oxygen concentration of less than 10 mass %, these were respectively defined as the ZnO region and the Ni—Fe—Zn alloy region, and the thickness of the ZnO region was determined. Further, from the concentrations of Zn, O, Mn and Si at the Ni—Fe—Zn alloy region, it was checked if the concentrations of these elements in the Ni—Fe—Zn alloy region decreased from the surface side of the plating layer toward the steel sheet side. Next, the identified ZnO region was divided at equal intervals into 10 sections, the Fe concentrations, Mn concentrations, and Si concentrations of the center positions of the sections were read from the GDS results, the totals of these concentrations at the sections were found, and the values of the 10 total concentrations of the Fe, Mn and Si obtained were averaged to thereby determine the average concentrations of the totals of Fe, Mn and Si of the sample. Next, from the obtained GDS results, the Ni—Fe—Zn alloy region was divided into a region having an Fe concentration of less than 60 mass % (first region) and a region having an Fe concentration of 60 mass % or more (second region). From the Zn concentration and Ni concentration at the first region, the maximum value and minimum value of the Zn/Ni mass ratio were found and the range of the Zn/Ni mass ratio in the first region was identified. Further, the second region was divided at equal intervals into 10 sections, the Zn concentrations and Ni concentrations of the center positions of the sections were read and the Zn/Ni mass ratios were found, and the 10 Zn/Ni mass ratios obtained were averaged to determine the average Zn/Ni mass ratio in the second region. The average concentration (mass %) of the total of Fe, Mn and Si, the Zn/Ni mass ratio in the first region, the average Zn/Ni mass ratio in the second region, and the thickness (μm) of the ZnO region of each sample are shown in Table 2. Regarding the "distributions of concentrations of Zn, O, Mn and Si in Ni—Fe—Zn alloy region" in Table 2, cases where all of these elements decreased in the Ni—Fe—Zn alloy region from the surface side of the plating layer toward the steel sheet side were shown as "good", while cases where they did not were shown as "poor".

(Evaluation of Corrosion Resistance on the Surface)

The corrosion resistance on the surface was evaluated by cutting out a 50 mm×50 mm size evaluation-use sample from each sample, allowing that sample to stand in a constant temperature/constant humidity chamber of a temperature of 70° C. and humidity of 70% for 1000 hours, then determining the red rust area rate. Specifically, the surface of the evaluation use sample after being allowed to stand in the constant temperature/constant humidity chamber was read by a scanner. After that, image editing software was used to select the regions were red rust was formed and find the red rust surface area. This procedure was performed on five evaluation-use samples for each specimen. The "red rust area rate" was determined as the average of the five rust areas obtained. Cases where the red rust area rate was less than 30% were evaluated as "good in corrosion resistance on surface", while cases where cases where the red rust area rate was equal to or greater than 30% were evaluated as "poor in corrosion resistance on surface". The results of evaluation of the corrosion resistance on the surface of the samples are shown in Table 2.

(Evaluation of Appearance)

The appearance was evaluated by measuring the area rate of dropped oxides at a bent part obtained using 90 degree V-dies at the time of hot stamping. Specifically, the surfaces parts of the samples were evaluated by examination under a SEM. Five fields continuously adjoining each other in a 200 μm×200 μm field of the head part of the bent part were examined by SEM. The area rate of dropped oxides was calculated from the F observed image in the different fields. The five values obtained were averaged to determine the "area rate of dropped oxides". Cases where the area rates of dropped oxides were less than 30% were evaluated as "good in appearance" while cases where the area rates of the dropped oxides were equal to or greater than 30% were evaluated as "poor in appearance". The results of evaluation of the appearances of the samples are shown in Table 2.

(Evaluation of Corrosion Resistance in Scratches)

Other 50 mm×50 mm evaluation-use samples were formed with diagonal length 70 mm cross-cut scratches reaching down to the underlying steel sheet, then subjected to a JASO-CCT test (M609-91) with spraying by saline (5% NaCl, 35° C.): 2 hours, drying (60° C., 20 to 30% RH): 4 hours, and wetting (50° C., 95% RH): 2 hours for 180 cycles and evaluated for corrosion resistance in scratches. Cases with blister widths of 2 mm or less were evaluated as "good in corrosion resistance in scratches" while those of more than 2 mm were evaluated as "poor in corrosion resistance in scratches". The results of evaluation of the corrosion resistance in scratches of the samples are shown in Table 2.

TABLE 1

Table 1. Properties of Plated Steel Sheet and Hot Stamping Conditions

| | Properties of plated steel sheet | | | | |
|---|---|---|---|---|---|
| | Zn-Ni plating layer | Ni plating layer | | Hot stamping conditions | |
| Sample no. | Zn/Ni ratio | Plating deposition (one surface) (g/m$^2$) | | Temperature (° C.) | Holding time (min) |
| 1 | 6.7 | 40.0 | 0.5 | 900 | 1.0 |
| 2 | 6.7 | 40.0 | 1.0 | 900 | 1.0 |
| 3 | 6.7 | 40.0 | 5.0 | 920 | 2.0 |
| 4 | 6,7 | 40.0 | 10.0 | 920 | 2.0 |
| 5 | 6.7 | 40.0 | 0.0 | 920 | 1.0 |
| 6 | 6.7 | 40.0 | 0.0 | 920 | 2.0 |
| 7 | 6.7 | 40.0 | 0.5 | 920 | 3.0 |
| 8 | 9.0 | 40.0 | 2.0 | 920 | 2.0 |
| 9 | 9.0 | 40.0 | 4.0 | 920 | 0.5 |
| 10 | 5.7 | 40.0 | 3.0 | 920 | 2.0 |
| 11 | 2.0 | 40.0 | 3.0 | 920 | 1.0 |
| 12 | 32.3 | 30.0 | 10.0 | 900 | 3.0 |

TABLE 2

Properties of Hot Stamped Body and Evaluation

| | Plating layer of hot stamped body | | | | | Evaluation | | | |
|---|---|---|---|---|---|---|---|---|---|
| Sample no. | Average concentration of total of Fe, Mn and Si in ZnO region (mass %) | Distributions of concentrations of Zn, O, Mn and Si in Ni—Fe—Zn alloy region | Average Zn/Ni mass ratio of first region | Average Zn/Ni mass ratio of second region | Thickness of ZnO region (μm) | Corrosion resistance on surface | Appearance | Corrosion resistance in scratches | Remarks |
| 1 | 4 | Good | 3.5 to 10.8 | 1.0 | 2.6 | Good | Good | Good | Ex. |
| 2 | 4 | Good | 3.7 to 10.5 | 1.1 | 2.7 | Good | Good | Good | Ex. |
| 3 | 4 | Good | 4.2 to 9.5 | 1.1 | 2.1 | Good | Good | Good | Ex. |
| 4 | 3 | Good | 4.6 to 8.2 | 1.4 | 1.3 | Good | Good | Good | Ex. |
| 5 | 8 | Poor | 3.5 to 11.0 | 1.0 | 2.9 | Poor | Good | Good | Comp. ex. |
| 6 | 16 | Poor | 3.1 to 11.6 | 0.9 | 3.4 | Poor | Poor | Good | Comp. ex. |

TABLE 2-continued

| Properties of Hot Stamped Body and Evaluation | | | | | | | | | |
|---|---|---|---|---|---|---|---|---|---|
| | Plating layer of hot stamped body | | | | | Evaluation | | | |
| Sample no. | Average concentration of total of Fe, Mn and Si in ZnO region (mass %) | Distributions of concentrations of Zn, O, Mn and Si in Ni—Fe—Zn alloy region | Average Zn/Ni mass ratio of first region | Average Zn/Ni mass ratio of second region | Thickness of ZnO region (μm) | Corrosion resistance on surface | Appearance | Corrosion resistance in scratches | Remarks |
| 7 | 18 | Poor | 3.3 to 10.7 | 0.9 | 3.5 | Poor | Poor | Good | Comp. ex. |
| 8 | 4 | Good | 4.0 to 9.3 | 1.1 | 2.6 | Good | Good | Good | Ex. |
| 9 | 1 | Good | 4.8 to 7.2 | 1.8 | 0.5 | Good | Good | Good | Ex. |
| 10 | 3 | Good | 4.0 to 9.3 | 0.9 | 2.3 | Good | Good | Good | Ex. |
| 11 | 1 | Good | 1.5 to 6.8 | 0.5 | 2.0 | Good | Good | Poor | Ex. |
| 12 | 9 | Poor | 8.8 to 18.4 | 2.7 | 3.2 | Poor | Poor | Poor | Comp. ex. |

Sample Nos. 1 to 4 and Nos. 8 to 11 had an average concentration of the total of Fe, Mn and Si in the ZnO region of more than 0 mass % and less than 5 mass %, therefore the corrosion resistance on the surface was excellent. Further, Sample Nos. 1 to 5 and Nos. 8 to 11 had a thickness of the oxide layer of 3.0 μm or less, so the appearance was excellent.

Further, in Sample Nos. 1 to 10, in the first region of the Ni—Fe—Zn alloy region, the Zn/Ni mass ratio was 3.0 or more and 13.0 or less while the average Zn/Ni mass ratio of the second region was 0.7 or more and 2.0 or less, therefore the blister width became 2 mm or less and the corrosion resistance in scratches was excellent.

Sample Nos. 5 to 7 had no Ni plating layer or had a low amount of deposition of the Ni plating layer, therefore the average concentration of the total of Fe, Mn and Si in the ZnO regions was 5 mass % or more. Large amounts of Fe, etc., were present at the surface layer of the hot stamped body, therefore relatively a large amount of red rust formed and the corrosion resistance on the surface was insufficient. Furthermore, Sample Nos. 6 and 7 had a thickness of the ZnO region of more than 3.0 μm and had a relatively large numbers of oxides dropping off at the surface layer of the hot stamped body, therefore the appearance was insufficient. Sample No. 11 had Ni excessively present compared with Zn in the Ni—Fe—Zn alloy region. The Zn, which exhibits the sacrificial anticorrosive action, was insufficient, therefore the corrosion resistance in scratches was insufficient. Sample No. 12 had an overly large Zn/Ni ratio of the Zn—Ni plating layer, therefore the melting point of the Zn—Ni plating layer dropped, etc., causing accelerated diffusion of Zn from the Zn—Ni plating layer and furthermore, along with this, accelerated diffusion of Fe and other constituents in the steel sheet. The thickness of the ZnO region became more than 3.0 tam, the average concentration of the total of Fe, Mn and Si in the ZnO region became 5 mass % or more, and as a result the appearance and corrosion resistance on the surface were insufficient. Furthermore, Sample No. 12 had Zn present in excess at the Ni—Fe—Zn alloy region. As a result, the Zn of the surface layer part became insufficient, therefore the corrosion resistance in scratches of the hot stamped body as a whole was insufficient.

INDUSTRIAL APPLICABILITY

According to the present invention, it is possible to provide a hot stamped body controlled in constituents derived from a steel sheet in a ZnO region present on a surface side of a plating layer and improved in corrosion resistance on the surface. Due to this, it is possible to provide an automobile member excellent in corrosion resistance on the surface. Therefore, the present invention can be said to be an invention extremely high in value in industry.

The invention claimed is:

1. A hot stamped body comprising a steel sheet and a plating layer formed on at least one surface of the steel sheet, wherein the plating layer is comprised of a ZnO region present on a surface side of the plating layer and having an oxygen concentration of 10 mass % or more and an Ni—Fe—Zn alloy region present on a steel sheet side of the plating layer and having an oxygen concentration of less than 10 mass %, and an average concentration of a total of Fe, Mn and Si in the ZnO region is more than 0 mass % and less than 5 mass %, wherein a thickness of the ZnO region is 0.5 μm or more and 3.0 μm or less.

2. The hot stamped body according to claim 1, wherein concentrations of Zn, O, Mn and Si in the Ni—Fe—Zn alloy region decrease from the surface side of the plating layer toward the steel sheet side.

3. The hot stamped body according to claim 1, wherein the Ni—Fe—Zn alloy region is comprised of, in order from a surface side of the plating layer, a first region having an Fe concentration of less than 60 mass % and a second region having an Fe concentration of 60 mass % or more, a Zn/Ni mass ratio in the first region is 3.0 or more and 13.0 or less, and an average Zn/Ni mass ratio in the second region is 0.7 or more and 2.0 or less.

4. The hot stamped body according to claim 3, wherein the average Zn/Ni mass ratio in the second region is 0.8 or more and 1.2 or less.

* * * * *